United States Patent [19]

Holmström et al.

[11] Patent Number: 4,608,083

[45] Date of Patent: Aug. 26, 1986

[54] METHOD FOR RECOVERING THE VALUABLE METAL CONTENT OF CONTAMINATED COPPER RAW MATERIAL

[75] Inventors: Sven Å. Holmström, Ursviken; Leif Johansson, Skelleftehamn, both of Sweden

[73] Assignee: Boliden Aktiebolag, Stockholm, Sweden

[21] Appl. No.: 775,403

[22] Filed: Sep. 12, 1985

[30] Foreign Application Priority Data

Sep. 28, 1984 [SE] Sweden ..... 8404863

[51] Int. Cl.[4] ..... C22B 11/00

[52] U.S. Cl. ..... 75/83; 75/75

[58] Field of Search ..... 75/83, 75, 1, 6, 7, 75/21, 23

[56] References Cited

U.S. PATENT DOCUMENTS

| | | | |
|---|---|---|---|
| 1,107,310 | 8/1914 | Johnson . | |
| 3,938,989 | 2/1976 | Bell | 75/6 |
| 4,242,124 | 12/1980 | Makipirtti | 75/6 |
| 4,344,792 | 8/1982 | O'Neill | 75/75 |
| 4,416,690 | 11/1983 | Richards | 75/75 |

FOREIGN PATENT DOCUMENTS

| | | |
|---|---|---|
| 7900104 | 3/1979 | PCT Int'l Appl. . |
| 8201381 | 4/1982 | PCT Int'l Appl. . |

OTHER PUBLICATIONS

The Institution of Mining and Metallurgy, Advances in Extractive Metallurgy 1977, "Study of Stibnite Chlorination: Thermodynamic and Experimental Aspects", R. Bloise et al, pp. 53–56.

The Institution of Mining and Metallurgy, Advances in Extractive Metallurgy 1977, "Segregation Roasting of Antimony Raw Materials", Ivan Imris, pp. 161–167.

*Primary Examiner*—Peter D. Rosenberg

*Attorney, Agent, or Firm*—Burns, Doane, Swecker & Mathis

[57] ABSTRACT

The invention relates to a method for recovering the valuable metal content of a mix of contaminated copper raw materials, of which materials at least one is sulphide bearing, and which contain one or more impurities forming the group arsenic, antimony, bismuth, mercury, tin, chlorine and other halogens. The invention is characterized by adjusting the halogen content of the mix so that it is substantially at least stoichiometric in relation to remaining impurities in the group, whereafter the mix is charged to a furnace in which melting can take place and in which the mix is heated to at least 500° C., but beneath the melting points of respective ingredients of the mix, while maintaining good contact with hot gas therewith to expel substantially all of the aforementioned impurities present. The mix is then heated to completely smelt the ingredients present, to form a slag and a copper matte, which latter contains the valuable metal content, whereafter this valuable metal content is recovered with the aid of a suitable, conventional method.

At least one of the copper raw materials present in the mix comprises suitably a halogen-bearing valuable-metal containing product, for example chlorine-bearing ash or slag.

14 Claims, 1 Drawing Figure

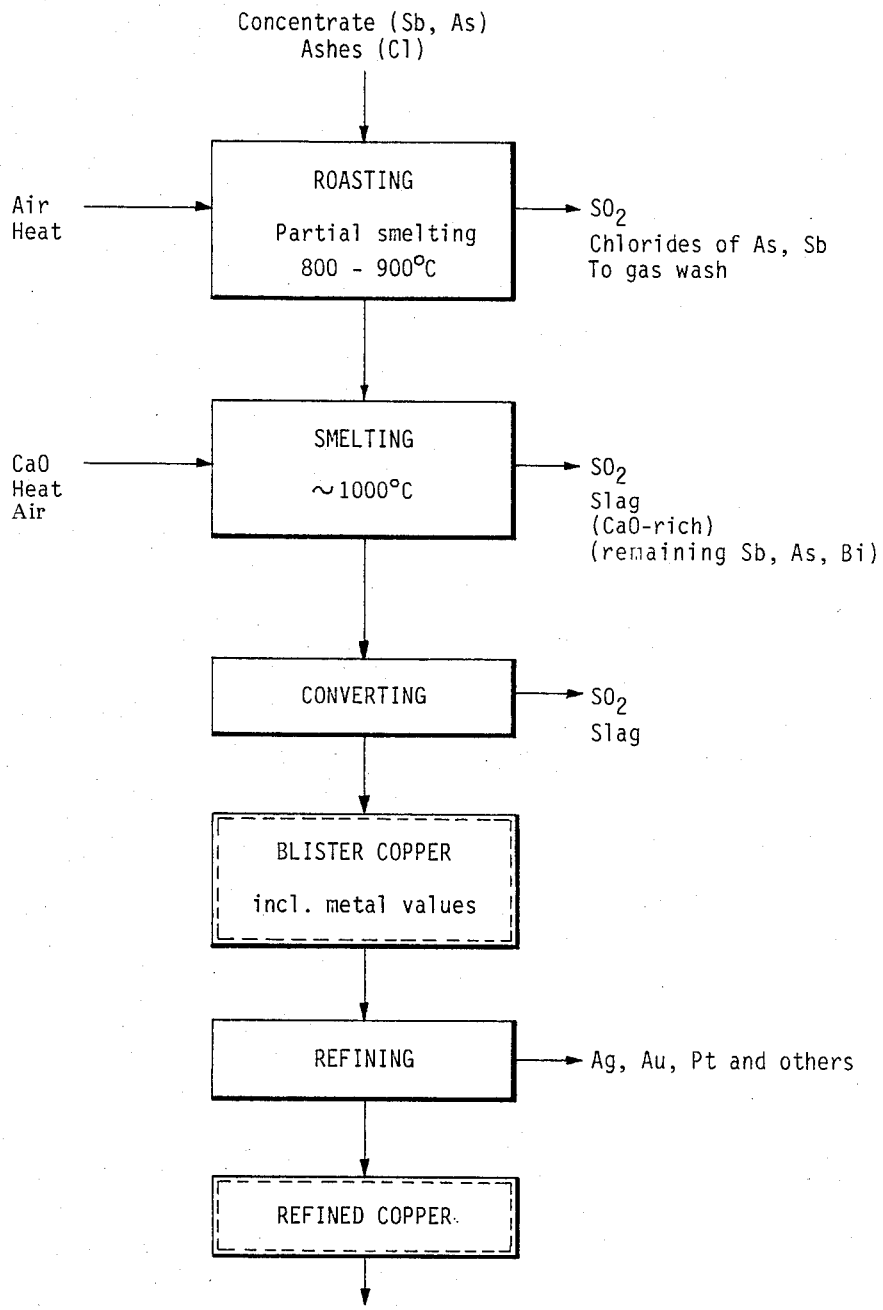
Concentrate (Sb, As)
Ashes (Cl)
Air
Heat
ROASTING
Partial smelting
800 - 900°C
$SO_2$
Chlorides of As, Sb
To gas wash
CaO
Heat
Air
SMELTING
~1000°C
$SO_2$
Slag
(CaO-rich)
(remaining Sb, As, Bi)
CONVERTING
$SO_2$
Slag
BLISTER COPPER
incl. metal values
REFINING
Ag, Au, Pt and others
REFINED COPPER

METHOD FOR RECOVERING THE VALUABLE METAL CONTENT OF CONTAMINATED COPPER RAW MATERIAL

The present invention relates to a method for recovering the valuable metal content from a mix of contaminated copper raw materials, of which at least one is a sulphide concentrate or some other product incorporating metal sulphide contaminated with antimony and/or bismuth, and which contain one or more impurities included in the group arsenic, antimony, bismuth, mercury, tin, chlorine and other halogens in quantities which are detrimental to the recovery of valuable metals when applying conventional metallurgical processes. More specifically, the invention relates to a method for working-up concentrates and other sulphidic materials metallurgically, for example matte, containing antimony and/or bismuth in total contents in excess of 0.5–1% by weight. The method also generally enables secondary copper raw materials containing chlorine and/or other halogens, such as ashes and slags to be worked-up.

Problems are often encountered when working-up ores containing antimony, partly because such ores normally contain large quantities of metal values and partly because when using physical methods it is impossible to produce metal concentrates in which the antimony content is of the low level required for the subsequent metallurgical processes to which the concentrates are subjected. What has been said in the aforegoing with respect to antimony also applies, to a large extent, to bismuth, even though hereinafter only antimony is discussed. Thus, the amount of antimony present in sulphidic copper concentrates and in sulphidic precious-metal concentrates varies considerably, and some concentrates can only be worked-up with great difficulty or with the inclusion of expensive further process stages. Because of this the present day market price of concentrates rich in antimony is much lower than that of the "purer" concentrates. In Table 1 below there is given, by way of example, a list of concentrates normally found on the market and containing antimony in amounts of 0.5% or thereabove.

TABLE 1

| Concentrate | Main average composition (% by weight) | | | | | | |
|---|---|---|---|---|---|---|---|
| Type/country | Cu | Fe | Sb | As | Bi | S | Ag |
| Equity/Canada | 20.3 | 25.4 | 3.48 | 4.4 | — | 33.1 | 0.43 |
| Algamarca/Peru | 27.5 | 18.3 | 5.0 | 5.0 | 0.11 | 30.0 | 0.22 |
| El Indio/Chile | 27.1 | 9.0 | 0.54 | 10.0 | 0.06 | 28.4 | 0.04 |
| Quiruvilca/Peru | 25.9 | 10.6 | 3.30 | 8.4 | 0.31 | 29.7 | 0.20 |
| Silver Field/ Canada | 4.0 | 11.6 | 0.50 | 9.4 | 0.10 | 12.6 | 1.70 |
| Lepanto/ Philippines | 30.6 | 12.1 | 0.71 | 10.3 | 0.04 | 30.6 | 0.02 |
| Sam Goosley/ Canada | 13.6 | 27.3 | 7.00 | 1.7 | 0.22 | 39.4 | 1.05 |
| Apirsa/Spain | 18.2 | 28.8 | 1.80 | 0.3 | <0.01 | 36.9 | 0.11 |

When concentrates of the kind listed in Table 1 are introduced as raw material in a conventional copper smelter, antimony will be partially roasted during the partial roasting process to which the ingoing sulphide concentrate is normally subjected. The extent to which the antimony can be roasted, however, is intimately connected with the amount of silver present in the concentrate, probably because it is more difficult to split-off antimony-containing minerals rich in silver than other antimony minerals. Actually, of the concentrates listed in Table 1, only Lepanto and El Indio can be charged to a conventional copper roaster to any appreciable extent. The remaining concentrates can only be taken into the copper process to a limited extent, wherewith the total accepted antimony intake, the so-called antimony ceiling, is dependent upon the unit processes available in the smelter being used.

The most usual method of "coping" with such smelt material is to dilute it with "pure material", to obtain a total antimony content which can be coped with. As will be understood, this can only be done provided that the highest acceptable antimony ceiling is not reached.

The antimony contained in concentrates which possess very high metal values can be eliminated from said concentrates by leaching with a sulphide solution. This method is particularly troublesome, however, especially with respect to the handling of the solution and its regeneration, and also with respect to problems arising in connection with the apparatus used. In addition, chemical costs are high and the leached concentrates cannot be subsequently dealt with as conventional roasted solids, but require the provision of additional separate process stages. A few small leaching plants intended for antimony-containing concentrates are in operation, however. In our earlier patent US-A-4,017,369 there is described a method for regenerating sulphide leaching solutions. As reported in this patent, however, the leaching method disclosed therein is only suitable for application in very particular cases.

Antimony can also be eliminated to a certain extent by subjecting the concentrate to an oxidizing partial roasting process with a prolonged residence time. Described in our earlier patent application SE-A-8303184-9 is a method intended for roasting arsenic-containing sulphidic concentrates, optionally having an elevated antimony content, for example concentrates of the El Indio and Lepanto kind. During the roasting process a substantial amount of the arsenic is eliminated from the concentrate, a large percentage of the antimony present also being eliminated at the same time. As mentioned in the introduction of this patent application, however, the roasting process described therein cannot be used in connection with concentrates rich in silver, and in the majority of cases the expulsion of antimony does not result in acceptable antimony levels, despite the fact that it is possible with such roasting processes to treat concentrates containing relatively high percentages of antimony, particularly when the roasting process is effected in two stages.

It is also possible to eliminate antimony in the later stages of the copper process, for example, by soda-refining blister copper, although this methodology is only applied to lower marginally the antimony content of isolated melts in order to adjust the antimony content of said melts to a level suitable for the subsequent refining stages. Both the chemical costs involved and the increased wear to furnace linings, however, make this method prohibitive for more general application.

Another method of eliminating high antimony contents in melts is by fuming-off the antimony while rolling the melts as described, for example, in our patent specification US-A-4,244,733 (corresponding to WO-A-79/00104). Rolling of the melts is effected in a rotary converter of the Kaldo type. The method, however, is only attractive in the case of isolated antimony peaks, since the process time in Kaldo furnaces is expensive and it is not usual for Kaldo furnaces to have additional capacity over and above that for which they are intended, i.e. primarily for smelting and possibly also for converting complex copper concentrates.

In US-A-1,107,310 silver-arsenic materials are processed by chlorination with moist chlorine gas to form gaseous arsenic chloride and solid silver chloride.

Methods have also been proposed for expelling antimony from antimony-rich material, in order to recover antimony values therefrom, particularly for the manufacture of antimony compounds, for example, antimony trioxide, by means of chlorinating volatilization with the aid of mutually different chlorides, for example, calcium chloride. Examples of such methods are found in R. Bloise et al, advances in Extractive Metallurgy 1977 London, IMM, pages 53–56 and G. Morizot et al, Complex Sulphide Ores, The Inst. Min. and Metallurgy 1978, pages 151–158. The metals present in the material, for example, lead, silver, copper and zinc, are assumed to form chlorides, and hence it is proposed that these chlorides may be recovered by leaching the resultant roasted solids. The method is also assumed to be suitable solely with respect to material containing minor quantities of valuable metals.

There is also described in the literature a 2-stage segregation process comprising chlorination and reduction stages for recovering antimony from oxidic antimony materials (Imris et al, Advances in Extractive Metallurgy 1977. The Institution of Mining and Metallurgy, pages 161–167). It has long been known to chlorinate sulphide ores at low temperatures, in order to recover metal and sulphur values therefrom. A summary of the process proposals considered to be of more importance in the present context are found in an article by H-W Parsons (CIM Bulletin 71, March 1978, 196–204). All of these processes relate to complete chlorination processes, and hence all of the metal-value content of the materials is converted to chlorides, in order to subsequently work-up the treated material hydrometallurgically. None of the materials described in this publication and subjected to chlorination treatment has contained As, Sb or Bi. Thus, the known chlorination processes are unable to provide a suitable input material for conventional smelters. Also oxidic materials are chlorinated so as to recover non-ferrous metals therefrom, for example such as described in our earlier WO-A-82/01381.

As disclosed in our earlier Swedish Patent Application No. SE-A-8305425-4 (corresponding to EP-A-0138794), copper and/or valuable-metal materials which contain antimony and/or bismuth can be subjected to a roasting process based on the use of chlorinating techniques. The treatment process is carried out at temperatures lying preferably between 550° C. and 650° C., at which temperature levels it is possible to expel substantially all antimony and optionally also the bismuth present from copper materials and/or valuable-metal materials bearing large quantities of these elements, without simultaneously expelling the metal values contained in the processed material or binding said values as chlorides to a prohibitive extent, and while ensuring that the processed material contains no unreacted residues of chlorinating agent. Temperatures in excess of 750° C. are not recommended, however, when carrying out the roasting process, since the charge is liable to fuse to form an agglomerated mass or to melt at such high temperatures, especially under the influence of the chloride supply.

It has now surprisingly been found possible to chlorinate partially similar materials in a manner which permits higher chlorinating temperatures to be used without disadvantage to the process technique applied or to the environment. The same good expulsion results can be achieved as those achieved with our aforesaid claimed method. In addition to enabling the treatment process to be effected more rapidly, as a result of being able to use higher temperatures, the method affords the additional advantage of enabling the partial chlorination and the subsequent smelting process to be effected in one and the same unit. The method also enables metal halogenide ashes to be worked-up, and at the same time also enables otherwise troublesome impurities such as arsenic, antimony and bismuth to be expelled from the sulphide material both rapidly and effectively.

The method is characterized by the procedural steps set forth in the accompanying claims.

When proceeding in accordance with the method, suplhide-bearing copper raw material, for example concentrates or mattes containing chlorinatable impurities such as arsenic, antimony and bismuth, together with valuable metals such as copper and silver, is mixed preferably with copper raw material containing chlorine and/or optionally other halogens, such as ashes, slag or solutions. These products often contain significant quantities of valuable metals. The halogen content of the mix is adapted so as to be at least stoichiometric with the other impurities to be eliminated, namely arsenic, antimony and bismuth, optionally together with tin and mercury. It has been found that chloride-bearing ashes lend themselves particularly well to such mixing processes. Ashes of the copper oxy-chloride type, $CuCl_2.3[Cu(OH)_2]$ have been found to be the best of these ashes in the present context.

When the halogen content of the mix is excessive, the content is lowered, suitably by adding raw material containing arsenic and antimony.

When, on the other hand, the halogen content of the mix is too low, there is added to the mix another halogen bearing material, preferably metal chlorides, alkali-metal chlorides or calcium chloride, either in a solid state or in solution.

Subsequent to adjusting the halogen content of the mix in the manner described, the mix is heated while in good contact with a hot oxidizing gas, to expel impurities in halogenide form. In this respect the temperature is maintained at a level above 500° C., but below the melting points of respective constituents of the mix.

The oxidizing heating process can thus be termed a roasting process which is effected in a chlorinating environment.

The roasting temperature is limited downwardly by the splitting temperature of the furnace bricking, and upwardly by the melting temperatures of respective mix ingredients. The formation of a liquid matte phase should be avoided in the initial stage of the roasting process, since the presence of a liquid bath would greatly impair the vaporization of the impurities, primarily antimony. The temperature is therefore maintained within a range of 700°–800° C. during at least the first part of the roasting period. The temperature can be allowed to increase during latter stages of this period to about 900° C., therewith to melt partially the ingredients, and even to such high temperature levels as to initiate complete smelting of the ingredients. At this stage the roasting period may pass gradually into, or overlap with the initial stage of the smelting period.

During the smelting period there is formed a slag and a copper matte which contain the valuable metal content of the mix.

Heating of the mix, expulsion of impurities, and smelting of the mix ingredients is effected in one and the same furnace unit. Suitable furnace units are all those with which a good gas-solids contact can be achieved, and which permit melting processes to take place, for example in such furnaces as shaft furnaces, short-drum rotary furnaces or rotary converters. It has been found that particular advantages are afforded when carrying out the method in a top blown rotary converter of the Kaldo type.

It is also within the scope of the invention to employ the process during autogenous flash-smelting of the ingoing mixture of reactant using oxygen. Thus, both the heating, expelling of impurities and smelting is carried out in the flame during the flash-smelting. All the steps are of course obtained in extremely rapid sequence, but under the provision that the charged materials are extremely fine-grained as normally is the case when flash-smelting, for example flotation concentrates, ashes and similar materials. It is surprisingly not too rapid to spoil the desired high refining results obtainable with the invention. Any arsenic is removed as gaseous arsenic trioxide together with outgoing sulphur-dioxide containing process gas, while any bismuth and antimony form volatile chlorides following the same process gas.

To facilitate the method, the mixture of copper raw material and optionally an external charge of halogen-bearing material is, or are, conveniently agglomerated before being heated.

In order to enable further improvement in the elimination of primarily antimony and bismuth, a fluxing agent derived from an external source is advantageously charged to the mix, the fluxing agent selected being one which produces a slag having the ability to bind the aforesaid impurities. The fluxing agent used in this respect is preferably lime, so as to obtain a slag rich in calcium oxide.

The halogen content of the mix is critical, insofar as it must be restricted so that only a minimum halogen residue remains in the treated material, while ensuring at the same time sufficiently low antimony and bismuth contents. This implies a halogen charge corresponding to a quantity immediately above the stoichiometric quantity calculated on the amounts in which those elements which are simultaneously volatilized as halogenides are present in the concentrate, i.e. in principle such elements as antimony, arsenic, mercury, tin and bismuth. Arsenic, mercury and tin are more readily expelled than the other elements, and the expulsion thereof therefore presents no problem when eliminating antimony. Thus, when antimony is eliminated to the extent desired, mercury, arsenic and tin will also be volatilized to a satisfactory extent. This represents no disadvantage with respect to the method, but rather a desirable feature from the aspect of process technology. It is only necessary to bear this in mind when calculating the quantity of halogen required.

The invention will now be described in more detail with reference to a preferred embodiment and to the accompanying drawing, together with working examples illustrating the preferred embodiment.

The single FIGURE of the accompanying drawing is a flow sheet illustrating a preferred embodiment of the invention as applied in the treatment of copper/silver concentrate and chloride-bearing ash or like waste products in a Kaldo converter.

Copper concentrate containing valuable metals, such as silver and other precious metals, together with impurities such as antimony, arsenic and bismuth, for example a type of concentrate having a composition similar to those set forth in Table 1, is charged to a Kaldo converter mixed with chloride-bearing ash, slag or some other valuable-metal bearing metallurgical waste product. The charge is first heated in contact with air to a temperature of 800°-900° C., partial smelting being optionally permitted to take place during at least the latter part of this period. During this oxidizing heating period, which can be characterized as a roasting process proceeding under partial smelting conditions, sulphur dioxide departs from the charge, together with chlorides of any antimony, arsenic, bismuth, mercury and tin present. The gas is passed to a venturi wash, where the chlorides are dissolved in the washing water and can be recovered. The temperature is raised progressively during the roasting stage to about 1000° C., or to the higher temperature required for smelting the mix ingredients to form the matte and slag. When all ingredients have been smelted, substantially the whole content of chlorinatable impurities will have fumed-off, although lime is nevertheless charged to the converter to form a slag rich in calcium oxide, this slage being able to absorb any residues of said impurities. The slag is then tapped-off and the residual matte converted to blister copper in a conventional manner, this conversion optionally being undertaken in the same Kaldo converter or in another converter, for example of the PS-type. The blister copper is refined in a conventional manner, either electrolytically or pyrometallurgically, to recover the copper and the valuable metal content.

The method according to the invention thus affords the unique possibility of, for example, de-chlorinating valuable-metal bearing chloride ashes, while expelling at the same time antimony and other chlorinatable impurities from copper concentrates containing silver and other precious metals. The chlorinatable impurities are herewith expelled selectively with respect to remaining metals. The roasting and smelting processes are also carried out in one and the same process unit, and these process stages are also integrated so as to be able to overlap one another in time. This enables the whole of the period up to the time at which complete smelting takes place, and therewith the prevailing high temperatures, to be utilized for the partial chlorination process.

EXAMPLE

Mixtures of Equity copper concentrate (analysis see Table 1) and various copper oxy-chloride bearing waste products were treated in accordance with the method according to the invention. These mixtures were first roasted in a furnace under agitation, at temperatures of 750°-800° C., for 60 minutes, whereafter smelting to matte took place.

The following chloride-bearing waste products were admixed in the various tests (% by weight):

Ash I: 63% Cu, 0.1% Ag, 4.8% $Cl^-$.

Ash II: 36% Cu, 0.2% Ag, 13% $Cl^-$.

Waste solution: 65% Cu, 16% $Cl^-$.

The test results are shown in Table 2 below, which also shows the analysis of the matte obtained and the selected roasting temperature and mixing conditions.

TABLE 2

| Mixture | Weight ratio | Temp °C. | % Cu | % Sb | % As | % Ag |
|---|---|---|---|---|---|---|
| Concentrate + ash I | 1:1 | 800 | 58.1 | <0.01 | 0.1 | 0.4 |
| Concentrate + ash I | 1:1 | 750 | 56.3 | <0.01 | 0.1 | 0.5 |
| Concentrate + ash II | 2:1 | 800 | 46.6 | 0.6 | 0.15 | 0.8 |
| Concentrate + solution | 2:1 | 750 | 49.5 | 0.01 | 0.1 | 0.6 |

The tests show that it is possible to combine the expulsion of chlorine from chlorine-bearing ash and chlorine-bearing solutions together with the expulsion of antimony and arsenic from silver/copper concentrate by subjecting the same to a roasting-smelting method according to the invention without losing precious metal.

We claim:

1. A method for recovering the valuable metal content from a mixture of copper raw materials of which at least one is sulphide bearing, said materials containing impurity from the group consisting of arsenic, antimony, bismuth, mercury, tin, halogens and mixtures thereof comprising:

(a) adjusting the halogen content of the mixture such that the amount of halogen is at least stoichiometric with respect to the remaining impurity in the mixture;

(b) heating the mixture in a furnace to a temperature of at least 500° C. and below the melting point of the mixture while maintaining the mixture in contact with gas produced therefrom by said heating whereby substantially all the impurity is expelled;

(c) heating the mixture to a temperature at which smelting occurs whereby a slag and a copper matte containing the valuable metal content is formed and wherein heating the mixture, expelling the impurity and smelting the mixture is conducted in the same furnace; and (d) recovering the valuable metal content from the copper matte.

2. The method of claim 1 wherein at least one of the copper raw materials forming part of the mixture is a halogen-bearing and valuable-metal bearing material.

3. The method of claim 1 wherein the mixture includes at leat one of chlorine-bearing ash and chlorine-bearing slag.

4. The method of claim 1 wherein when the halogen content of the mixture is too high, the halogen content is adjusted by adding arsenic and antimony bearing raw material.

5. The method of claim 2 wherein when the halogen content of the mixture is too low, the halogen content is adjusted by adding a halogen bearing material in solid state or in solution.

6. The method of claim 5 wherein the halogen bearing material is selected from the group consisting of alkali metal chlorides, calcium chloride, metal chlorides and mixtures thereof.

7. The method of claim 1 wherein the furnace is a shaft furnace, rotary converter or short drum rotary furnace.

8. The method of claim 1 wherein the heating, expelling and smelting are conducted while autogeneously flash-smelting the mixture.

9. The method of claim 8 wherein the mixture is agglomerated prior to heating said mixture.

10. The method of claim 1 wherein the mixture is agglomerated prior to heating said mixture.

11. The method of claim 9 wherein a fluxing agent is added to the mixture to form a slag having a composition capable of binding impurity.

12. The method of claim 1 wherein a fluxing agent is added to the mixture to form a slag having a composition capable of binding impurity.

13. The method of claim 12 wherein lime is added to the mixture to form a slag rich in calcium oxide.

14. The method of claim 11 wherein lime is added to the mixture to form a slag rich in calcium oxide.

* * * * *